US009180467B2

(12) United States Patent
Bartsch et al.

(10) Patent No.: US 9,180,467 B2
(45) Date of Patent: Nov. 10, 2015

(54) CONTINUOUSLY OPERATING CENTRIFUGE

(75) Inventors: Eckhard Bartsch, Evessen (DE); Hans-Heinrich Westendarp, Braunschweig (DE)

(73) Assignee: BMA Braunschweigische Maschinenbauanstalt AG (DE)

( * ) Notice: Subject to any disclaimer, the term of this patent is extended or adjusted under 35 U.S.C. 154(b) by 956 days.

(21) Appl. No.: 13/319,524

(22) PCT Filed: May 14, 2010

(86) PCT No.: PCT/EP2010/056654
§ 371 (c)(1),
(2), (4) Date: Jan. 25, 2012

(87) PCT Pub. No.: WO2010/130827
PCT Pub. Date: Nov. 18, 2010

(65) Prior Publication Data

US 2012/0142513 A1 Jun. 7, 2012

(30) Foreign Application Priority Data

May 15, 2009 (DE) ..... 10 2009 021 588

(51) Int. Cl.
*B04B 11/06* (2006.01)
*B04B 3/00* (2006.01)
*B04B 15/08* (2006.01)

(52) U.S. Cl.
CPC . *B04B 3/00* (2013.01); *B04B 11/06* (2013.01); *B04B 15/08* (2013.01)

(58) Field of Classification Search
CPC ..... B04B 2005/0464; B04B 3/00
USPC ..... 494/67; 210/377, 380.1; 127/19, 56
See application file for complete search history.

(56) References Cited

U.S. PATENT DOCUMENTS

| | | | | |
|---|---|---|---|---|
| 2,353,983 | A * | 7/1944 | Banning | 494/57 |
| 3,837,913 | A * | 9/1974 | Hillebrand et al. | 127/19 |
| 4,033,879 | A * | 7/1977 | Natt et al. | 210/369 |
| 4,052,304 | A | 10/1977 | Vertenstein | |
| 4,718,945 | A * | 1/1988 | Schaper et al. | 127/9 |
| 5,244,502 | A * | 9/1993 | Schaper et al. | 127/19 |

FOREIGN PATENT DOCUMENTS

| | | |
|---|---|---|
| DE | 123 174 | 11/1900 |
| DE | 26 31 178 | 1/1978 |

(Continued)

*Primary Examiner* — Charles Cooley
*Assistant Examiner* — Marc C Howell
(74) *Attorney, Agent, or Firm* — Salter & Michaelson

(57) ABSTRACT

A continuously operating centrifuge for centrifuging sugar massecuites has an upwardly flaring conical sieve basket (20) which rotates about a vertical axis (16). A product distributor (40) flares downwardly and extends into the bottom region of the sieve basket (20). The product distributor (40) is substantially coaxial with respect to the sieve basket (20), has a discharge rim and rotates about the same vertical axis (16) as the sieve basket (20). Within and in the upper region of the product distributor (40), there is provided a distributor pot (30) which serves as a feeding device for the sugar massecuites in the axial region of the centrifuge. The peripheral wall of the product distributor (40) is divided up into a plurality of ring elements (41, 42, 43) which overlap in the direction of the axis (16) and the internal diameters of which differ from each other. A bell (50) surrounds the product distributor (40) and flares conically downwardly. A device (61, 62) incorporating air directing elements is provided between at least two of the ring elements (41, 42, 43) of the product distributor (40).

22 Claims, 3 Drawing Sheets

(56) References Cited

FOREIGN PATENT DOCUMENTS

| | | | |
|---|---|---|---|
| DE | 22 07 663 | C3 | 4/1984 |
| DE | 38 28 204 | C2 | 8/1990 |
| EP | 0 152 855 | A2 | 8/1985 |
| EP | 0 152 855 | A3 | 8/1985 |
| EP | 0 487 780 | B1 | 6/1992 |

* cited by examiner

CONTINUOUSLY OPERATING CENTRIFUGE

TECHNICAL FIELD

The invention relates to a continuously operating centrifuge for centrifuging sugar massecuites comprising a conical upwardly flaring sieve basket which rotates about a vertical axis, comprising a conical downwardly flaring product distributor which extends down to the bottom region of the sieve basket, is substantially coaxial with respect to the sieve basket, forms a discharge rim at the bottom thereof and rotates about the same vertical axis as the sieve basket, comprising a distributor pot which is disposed within and in the upper region of the product distributor and serves as a feeding device for the sugar massecuites in the axial region of the centrifuge, comprising a division of the peripheral wall of the product distributor into a plurality of ring elements which overlap in the axial direction, comprising a conical downwardly flaring bell which surrounds the product distributor.

BACKGROUND OF THE INVENTION

Centrifuges by means of which sugar is centrifuged and with the aid of which the syrup flowing away can be thickened at the same time are already known from DE 123 174 B1 for example. These historical concepts have rotating sieve drums which are provided with screw-shaped blades at the upper or lower end faces thereof. Air is thus forced to pass through the sieve drums and thereby produce the desired evaporation process.

More modern continuously operating centrifuges, for centrifuging sugar massecuites are already known from CE 22 07 663 C3, CE 26 31 178 A1 or DE 38 28 204 C2 for example. Continuously operating centrifuges of this type, which are also designated as sugar centrifuges or continuous, centrifuges as catchwords, can be used in the cane sugar and sugar beet industries as well as in sugar refineries. They serve for mixing, distributing and accelerating the sugar massecuites that are being supplied thereto and thereby releasing the crystals from the syrup by means perhaps of a washing process involving the addition of water or steam.

The sugar massecuite is first supplied so a distributor pot serving as a feeding device. This is located in the axial region of the centrifuge and is intended so produce a distribution of the sugar massecuite which is as uniform as possible in the radial direction ready for further processing in the centrifuge. The massecuite is carried along in the distributor pot by adhering to the wall of the distributor pot and is thus gradually accelerated up to the peripheral speed of this wall. The massecuite is thereby distributed over the periphery of the distributor pot and is eventually spun-off over the upper edge of the distributor pot clue to the constant inflow of massecuite.

After covering a short stretch in free flight, the sugar massecuite strikes the inner surface of the product distributor which may also be referred to as an acceleration bell or a forerunner drum. During the free flight of the sugar massecuite, it is subjected to steam or wash-water issuing from corresponding feed lines.

Instead of or prior to being fed into a rotating distributor, the sugar massecuites could also be heated in a stationary, non-rotating element as is proposed in U.S. Pat. No. 4,052,304, whereby steam from the centrifuge is fed upwardly through the stationary element in the form of an eddy current. For this purpose, nozzle-like openings can be provided in the wall, of the stationary element.

The rotating product distributors in the centrifuges known from DE 22 07 663 C3 or DE 38 28 204 C2 for example are similar to a drum and flare-out slightly in the manner of a cone in the downward direction. At the lower periphery thereof, they form a discharge rim from which the sugar massecuites arriving there are spun off outwardly into the actual, conical, upwardly flaring sieve basket which rotates about the same vertical axis.

If the massecuite has a relatively high viscosity, it is prone to distribute itself unevenly and will form a layer of varying thickness on the inner surface of the product distributor. In order to counter this effect, it is proposed in EP 0 152 855 A3 that the peripheral wall of the product distributor should be subdivided into concentric ring elements of differing diameter that are arranged one within the other and thereby keep the spaces between the ring elements open in the upward and downward directions. Hereby, the ring elements should have a free upper and lower horizontal centrifuging rim in order to enable in this way the massecuites to be spun-off both above and below the respective ring elements.

Continuously operating centrifuges can be improved still more following a proposal in EP 0 487 780 B1. Continuously operating centrifuges utilising this concept have proved to be extremely satisfactory in practice and are widely used. Hereby, the product distributor is composed on the one hand of a plurality of mutually spaced, conically downwardly flaring ring elements, whilst on the other hand, the entire product distributor is surrounded by a downwardly flaring conical stationary bell which surrounds it with play on all sides.

In addition, the sugar centrifuges described in EP 0 487 780 B1 guide the sugar massecuites firstly into a distributor pot, and from there, to the first of the ring elements of the product distributor from where the sugar massecuites then move on to the next ring element, after moving across the annular gap, and finally they rise upwardly on the wall thereof due to the centrifugal forces operative on the sieve basket.

The individual ring elements are rigidly connected to one another by means of webs and accordingly rotate in synchronism. Apart from the webs, the annular gaps are free and thus make is possible for air to flow through the annular gaps in a direction that is approximately parallel to the ring elements, this thereby improving the process of homogenising the sugar massecuites which move radially outwardly in a direction perpendicular to the air flow whilst the air is flowing there through The bell is stationary thereby enabling air and/or steam to be supplied from above into the region within the bell in a simple form.

In practice, there is considerable interest in making further improvements to precisely these proven and widely employed continuously operating centrifuges for centrifuging sugar massecuites.

Consequently, the object of the invention is to propose a continuously operating centrifuge of the type indicated in the Preamble of the main Claim which, enables such further improvement to be made,

SUMMARY OF THE INVENTION

In accordance with the invention, this object is achieved in that there is provided between at least two of the ring elements of the product distributor a device comprising air directing elements consisting of horizontally disposed metal sheets with planar surfaces, and in that a multiplicity of sheet metal surface areas issue upwardly from these surfaces in wing-like or blade-like manner.

The object is thereby achieved. In this way, there thus results a continuously operating sieve-type centrifuge incorporating a multi-stage product distributor. During the passage between the stages of the product distributor in the form of the above mentioned ring elements, air or another gaseous medium is drawn through or fed through between the ring elements by means of the air directing elements.

The spaces in the multi-stage product distributor that are already provided in the well-proven and well-known sugar centrifuges of EP 0 487 780 B1 are now used not only to cause jumps and intermixing of the sugar crystals and hence homogenisation thereof, but streams of air flowing almost perpendicularly to the sugar crystals flying radially outwardly are deliberately introduced into the region of this free path which is being traversed by the sugar crystals between the ring elements.

Until now, one had to fall back on the pressure ratios within the bell in order to obtain such a flow, this however merely resulted in relatively low rates of flow. In accordance with the invention however, the air directing elements can be formed practically freely and lead to relatively high rates of flow since the rotational speeds of the product distributor about the axis of the centrifuge are also relatively high.

In addition, this gives rise to the possibility of introducing or facilitating not just a flow of air into the region between the product distributor and the bell but also of specifically utilising an appropriately enriched gaseous medium and then letting this medium flow between the ring elements, thus for example, steam or else an air or steam-like medium enriched with syrup droplets to which the free-flying sugar crystals can be subjected and thereby thoroughly mixed when in this state, this then being useable for an additional cleaning process and the removal of impurities.

What must also be taken into consideration here is that there is also a constant acceleration of the crystal suspension together with the water or syrup droplets to which it was subjected and which may be contained therein due to the conically downwardly flaring ring elements and the constantly increasing diameter, this then further assisting the corresponding removal processes.

It is useful for a device comprising air directing elements of this type to be provided between each two of the ring elements of the product distributor.

As a consequence thereof, the charging process can occur during each of several such abrupt movements of the crystal suspension.

It is practical for the product distributor to be subdivided into three ring elements. A higher number is possible, but is constructionally more complex and two jumps can already be enforced in the way described using three ring elements.

The devices incorporating the air directing elements are formed in such a way that they have horizontally disposed metal sheets with planar surfaces. Hereby, a plurality of sheet metal surface areas issue upwardly from these surfaces in wing-like or blade-like manner.

This thereby results in a particularly practicable form for the air directing elements since the devices can be used at the same time for the purposes of connecting the ring elements and one can thus dispense with other types of supporting constructions for the rotating parts of the product distributor.

Moreover, by virtue of the horizontally disposed metal sheets with planar surfaces, the region occupied by the air directing elements can also be well defined.

One arrangement that has proved its worth in tests is for the devices to be in the form of pressed parts into which lines are inscribed by means of a laser, whereby the lines are arranged in such a manner as to enable triangular or square regions to be bent up.

Devices manufactured in this way are particularly economical and, at the same time, they are reliable and producible in a uniform manner.

If the lines inscribed by the laser are rounded at the ends thereof, further splitting of the inscribed lines can be prevented. One should take into consideration that relatively high mechanical loads are effective on these devices due to the high rotational speeds of the product distributor and its ring elements, particularly when additional supporting functions are associated therewith.

For an optimal air directing process, it has proven worthwhile for the air directing elements to be set at an angle of more than 30° and less than 50°.

In one preferred form, the angles can additionally be kept adjustable in order to take into account the possibility of converting the centrifuge for another filling material, a sugar of differing composition for instance. Hereby, one should also bear in mind that the sugar massecuites differ from year to year in regard to their various physical properties which are affected by the differing climatic conditions in which the sugar beet or possibly the sugar cane are grown and from which the sugar massecuites are obtained.

In a particularly preferred embodiment, provision is made for the conically downwardly flaring bell surrounding the product distributor to rotate at the same frequency and about the same axis as the product distributor.

In contrast to the state of the art, the bell or hood is deliberately configured to rotate therewith. Whilst in the state of the art a stationary bell was of advantage in order to create certain pressure ratios in the annular space between the product distributor and the bell, this is now no longer of compelling necessity in the light of the provision of the air directing elements between the ring elements so that the advantages of a co-rotating bell can be used. These advantages consist in the fact that there are no longer any relative movements between the ring elements and the bell and thus too, that specific safety margins no longer have to be provided for the case of a malfunction or the like.

Moreover, a particularly preferred embodiment of the invention makes use of the common rotation of the bell and the product distributor and its ring elements, in that air directing elements, for example air baffle plates, are also arranged between the product distributor and the bell or hood.

It is also of quite especial, advantage however, if the lowest region of the inner wall of the bell can project downwardly beyond the product distributor and be formed in such a way as to provide a further ring element for the capture and the further transportation of the sugar massecuites spun off from the discharge rim of the product distributor. This additionally arising ring element has the advantage that the sugar massecuite, which strikes the inner surface of this further ring element, is not braked as was the case with a stationary bell in EP 0 437 780 B1, but rathermore, it is in fact subjected so an additional acceleration. To be taken into consideration hereby, is that, due to the same frequency of revolution, the rotational speed (considered as the distance covered per unit of time at the periphery of the inner face of the co-rotating bell) continues to increase due to the ever increasing diameter.

Especially in the case where the lowest region of the inner wall of the bell protrudes downwardly beyond the product distributor, the provision of further air directing elements is of special advantage, as can easily be envisaged.

In the particularly preferred embodiment, this thereby results in a fourth ring element without the need for the product distributor to be subdivided into four ring elements. A third jump between the lowest ring element of the product distributor and this additional ring element is thus obtained without greater mechanical complexity.

Naturally, this advantage is also gained if the product distributor were to consist of four or even of just two ring elements from the outset.

It is of further advantage, if a supply element or a plurality of supply elements are provided through which a medium such as air, steam or steam enriched with syrup droplets is supplied to the interior of the bell. As already mentioned above, the effect can thereby be achieved that the sugar crystals in free flight are exposed to certain additives by the flow of air or the flow of steam.

It is preferred that the supply element for the bell should introduce the medium, i.e. air, steam or steam enriched with syrup for example into the annular space between the inside of the bell and the exterior of the ring elements of the Product distributor from above. This is clearly much simpler to realize mechanically.

In principle, it would also be possible to effect the supply of steam or air into the product distributor from below and then let it flow upwardly through the air guidance elements of the devices between the ring elements. To this end, the air guidance elements would have to be set up in a correspondingly different manner in order to produce a suction effect from bottom to top. This, however, is technically more complex and thus more expensive.

Further features are described in the appendant Claims.

DESCRIPTION OF THE DRAWINGS

An exemplary embodiment of the invention is described in greater detail hereinafter with the aid of the drawings. Therein.

DETAILED DESCRIPTION

Figure 1:
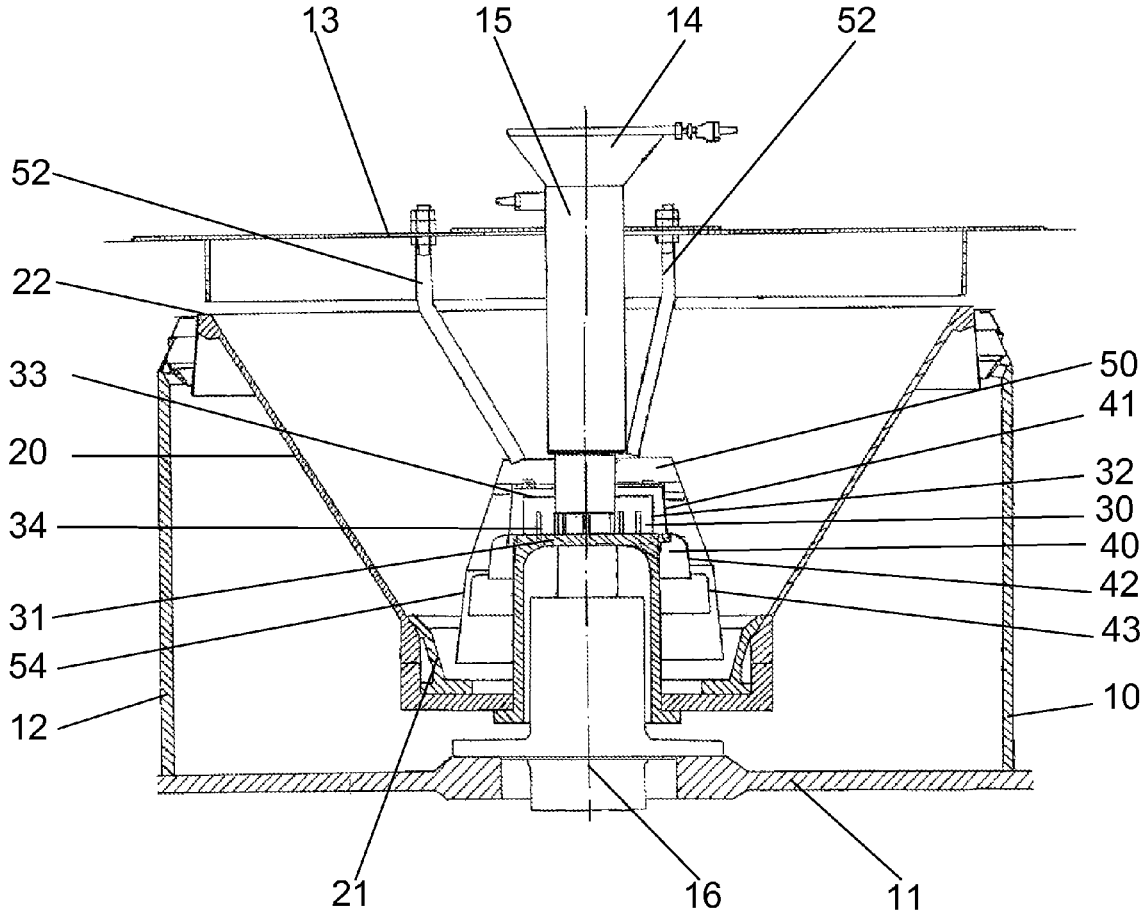
FIG. 1 shows a section through an embodiment of the invention.

The centrifuge illustrated in FIG. 1 serves for centrifuging sugar massecuites in order to firstly separate mother solution from so-called magma in the course of a multi-stage treatment. and then to cleanse the sugar crystals released from the mother solution of the remaining impurities.

The centrifuge has a fixed framework 10 comprising a base 11, side walls 12, a cover 13 and a filler funnel 14. The sugar massecuite is fed into the filler funnel 14 and then enters a shaft 15. The filler funnel 14 and the shaft 15 are also fixed.

Also clearly visible to the observer is a sieve basket 20 which extends from the base region 11 almost up to the cover 13 in the upper region of the centrifuge. The sieve basket 20 is axially symmetrical with respect to a vertical axis 16 and flares upwardly from the bottom in conical manner. Sugar particles migrate upwardly on the inner wall of this sieve basket 20 during a relatively rapid rotation of the sieve basket 20 and are then spun off outwardly at the top rim 22 of the sieve basket 20.

Before the sugar massecuites reach the inner wall of the sieve basket 20 from the shaft 15, they fall into a distributor pot 30 and from there, into a product distributor 40. The sieve basket 20, the distributor pot 30 and the product distributor 40 rotate about a common vertical axis 16 which also represents the axis of the non co-rotating shaft 15 at the same time The distributor pot 30 is drum-shaped and has a closed base 31 and cylindrical walls 32.

The sugar massecuites being filled into the filler funnel 14 emerge from the filler funnel 14 into the shaft 15 and enter the distributor pot 30. Vertical bars 34 which serve for mixing and for homogenizing the sugar massecuites within the distributor pot 30 are disclosed within the distributor pot 30. The sugar massecuites are agitated to a certain extent and moved relative so each other by these bars 34. Since the contents of the distributor pot 30 are being constantly replenished by further sugar massecuites, they are pushed upwardly from there over a rim 33 of the cylindrical wall 32. The particles of the sugar massecuites are subjected to a centrifugal force due to the rotating wall 32 of the distributor pot 30. They are spun of outwardly by this centrifugal force and strike the inner wall of the product distributor 40.

The product distributor 40 and the distributor pot 30 are connected to one another and rotate together.

The product distributor 40 consists of a plurality of annular elements. These annular elements 41, 42, 43 and a further ring element 54 which will be described in more detail hereinafter are concentric with respect to each other and to the axis 16. The respective diameters thereof widen out in the downward direction and each one of these four ring elements 41, 42, 43 and 54 also flares out downwardly in conical manner. In all other respects however, each of the ring elements is cylindrically symmetrical.

Accordingly, the diameter becomes larger in abrupt manner between the peripheral lower edge of a respective ring element 41, 42 and 43 and the upper peripheral edge of the next-following ring element 42, 43 and 54.

The attachment of the ring elements to one another in these jump regions is described in more detail hereinbelow with reference to FIGS. 2 and 3.

The ring elements 41, 42, 43 of the product distributor 40 are surrounded with all-round play by a hood or bell 50 which flares downwardly in conical manner. This bell 50 projects downwardly beyond the ring 43 and, in this way, the lower region thereof forms the ring 54. The bell 50 rotates with the product distributor 40 and is likewise symmetrical with respect to the axis 16.

A supply of medium is fed into the region between the outer surfaces of the ring elements 41, 42, 43 of the product distributor 40 and the inner surface of the bell 50 incorporating the ring element 54 from above by means of a supply element 52. This supply of medium via the supply element 52 serves to introduce steam or air or possibly another gas or else a medium containing finely distributed portions of syrup or other additives into the region within the bell 50 and outside the product distributor 40. This medium is a medium that is used for the processing of a crystal suspension for example.

Figure 2:
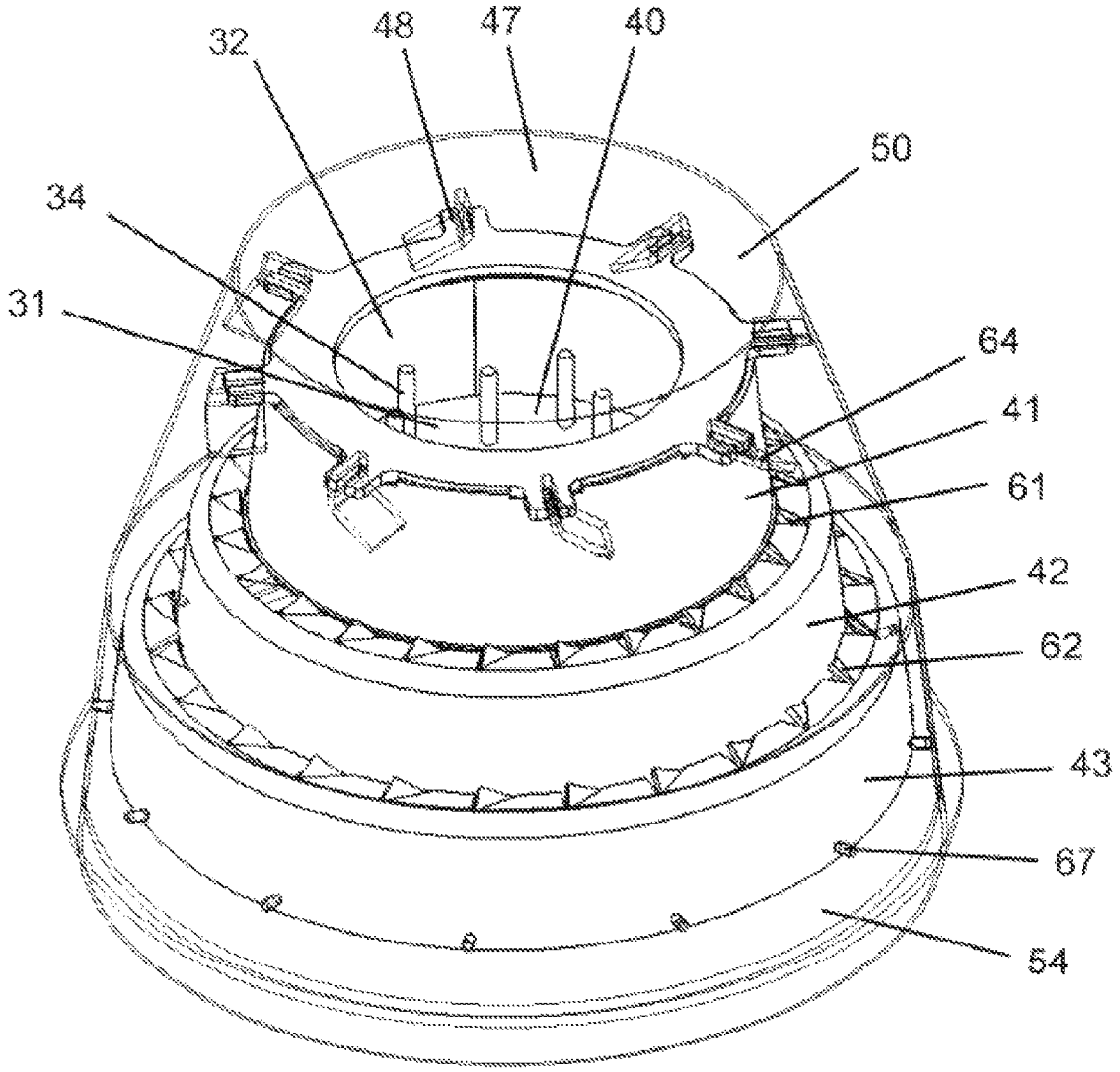
FIG. 2 a perspective illustration of a detail, of the embodiment depicted in FIG. 1.
Figure 3:
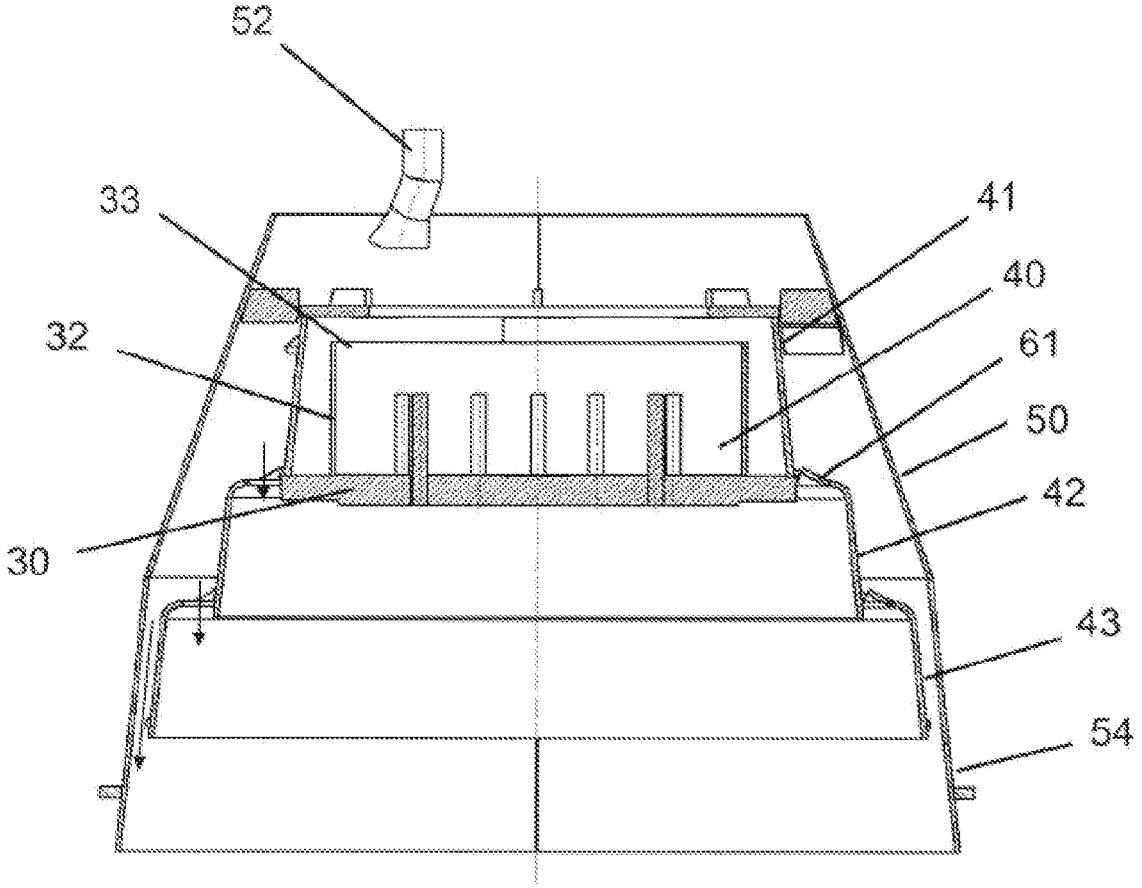
FIG. 3 a section through the detail depicted in FIG. 2 on a larger scale.

This medium then passes through the regions between the rings 41, 42, 43, 54 in conjunction with the shape that is explained in more detail in the descriptions of FIGS. 2 and 3 into the region within the product distributor 40 and is thereby applied to the sugar massecuites present therein.

Due to the rotating ring elements 41, 42, 43, 54 of the product distributor 40 or the bell 50, the sugar massecuites or crystal masses of the crystal suspension that are centrifuged out of the distributor pot. 30 onto the inner wall of the ring element 41 pass from one ring element 41, 42, 43 to the next-lower one, the conical ring element 42, 43, 54 outwardly surrounding the prior one. Hereby, they are circulated and homogenized each time they negotiate the difference in diameter between two ring elements 41, 42, 13, 51, as they are simultaneously being subjected to the steam, air or the other media that is being used in particular for the processing of a crystal suspension.

Due to the centrifugal force, the processed sugar massecuites are spun off outwardly from the spin-off edge of the lowest ring element 54 which is formed simultaneously by the lower edge of the bell 50. Thereby, they strike the deflector plate 21 in the lower region of the conically upwardly flaring sieve basket 20.

From this deflector plate 21, they then reach a sieve that is rigidly connected to the basket-base of the sieve basket 20 and this deflector plate 21 and they migrate upwardly on the sieve of the sieve basket. 20 due to the centrifugal force. A water feeding device can be provided in the region of the deflector plate 21.

The sieve basket 20 is terminated at the top by a rim 22. The sugar particles are spun off outwardly from this rim 22, caught and then further processed there (not illustrated).

The bell 50 together with the product distributor 40 and the ring elements and also some further details are shown enlarged in the perspective illustration depicted in FIG. 2. The bell 50 is represented as being transparent here, but in practice however, this is not the case.

One can see here, that a space, in which steam, air or a medium intended for the processing of the crystal suspension or the sugar massecuites can be present, is formed between the inner surface of the bell 50 and the outer surface of the ring elements 41, 42 and 43 of the product distributor 10. The supply of this medium or the steam or the air is effected from above by means of the supply element 52 that is not illustrated in FIG. 2, in like manner to the way in which she supply of the sugar massecuites from above is effected into the distributor pot 30 from above via the shaft that is omitted here. Looking from above into this distributor pot 30 at an oblique angle in FIG. 2, one sees the base 31 from which some bars 34 project upwardly.

Similarly, one can also perceive the cylindrical walls 32 of the distributor pot 30, but not however the upper rim 33 thereof which is covered over here.

This upper rim is concealed by a horizontally extending ring-shaped cover surface 47 which protrudes over this upper rim 33 of the cylindrical walls 32 in the direction of the axis 16, and projecting outwardly therefrom towards the bell 50 there are projections 48 that support the bell or are fixed thereto.

The three ring elements 41, 42 and 43 of the product distributor 40 are easily perceptible in FIG. 2. One views these from the outside. This means that the sugar massecuites are spun outwardly from the interior of the distributor pot. 30 over its non-visible upper rim 33 and strike the inner surface of the highest ring element 41. Since this element flares conically downwards and all the ring elements 41, 42, 43 of the product distributor 40 rotate with the distributor pot 30, the sugar crystals are transported downwardly on the inner wall of the ring element 41 due to the centrifugal, force.

These sugar crystals and any other particles are spun oft outwardly again at the lower rim of the highest ring element 41. They then strike the upper rim of the next-following ring element. 42. Due to the fact that the diameters of the two coaxial ring elements 41 and 42 are different, a distance in the radial direction has to be overcome for the purposes of jumping from the lower rim of the ring element 41 to the upper rim of the ring element 42. In accordance with she invention, the annular gap extending in the conventional centrifuges known from EP 0 487 780 B1 is covered here by a device 61 consisting of numerous air guidance elements or air directing elements. In the illustrated preferred embodiment, this device 61 comprises an annular metal sheet which covers this annular gap and is manufactured using a pressing process. Hereby, tongues are inscribed into the pressed parts preferably by means of a laser beam and these tongues that are initially only marked-out by means of the scribe lines are then subsequently transformed in the pressing process in such a way that a kind of baffle plate is formed.

Each of the tongues of the device 61 projects upwardly in the same form as a baffle plate. As one can perhaps perceive in the perspective drawing, they all have the same bending angle of preferably about 40 degrees. The size of this bending angle can be selected and optimised in dependence on the consistency of the sugar massecuites that are to be processed in the centrifuge, perhaps also taking into consideration a preferred rotational speed of the ring elements 41, 42, 43 about the axis 16.

The exact shape of the baffle plates or the tongues of which the baffle plates are formed can also be modified in order to meet specific requirements and they could be triangular or quadrangular for instance.

The function of the baffle plates is to additionally create or amplify a suction effect in the product distributor 40 thereby producing a current of air or steam or a current of the medium that is intended for the treatment of the crystal suspension, namely, a flow from above through the regions in the metal sheet of the device 61 comprising she air guidance elements that have been opened up by the curved tongues. In this embodiment, the baffle plates or tongues represent the air guidance elements of the device 61.

Due to the fact that there is a suction effect into the interior of the product distributor 40 due to the air guidance elements of the device 61, one can dispense with the complete upward closure of the bell 50 in the upper region of the bell 50 which was conventionally necessary in order to utilise the pressure ratios created by the supply of air, steam or other media to the bell by means of the supply element 52 and thereby produce the flow through the conventional annular gap into the interior of the product distributor.

The supply element 52 is only needed now in order to have an effect upon and to specify the composition of the medium or the steam or the air in the region within the bell 50 and outside the product distributor 40.

The medium flowing through the air baffle plates of the device 61 incorporating the air guidance elements flows downwardly quasi parallel to the surfaces of the ring elements 41 and 42; the direction of flow is not necessarily precisely vertical, but rather, it is affected by the air guidance elements. In any case, the sugar crystals that have been spun-off outwardly in the horizontal direction are subjected to a forceful and substantial impact by the media flowing perpendicularly thereto, said sugar crystals being subjected in this way to the steam molecules or other desired additives.

The sugar crystals that have been impacted in this way as well as the other substances located on the inside of the ring element 42 are now also transported downwardly here due to the centrifugal force until they encounter the transition point between the lower rim of the ring element 42 and the upper rim of the ring element 43.

Here, the same process is repeated since the intermediary space between the lower rim of the second ring element 42 and the upper rim of the third ring element 43 is also arranged to be of the same shape and comprises a device 62 incorporating air guidance elements which correspond to those of the device 61, although they are of somewhat greater diameter. This can entail the air baffle plates or air guidance elements being of a different design, and the number thereof could also differ from those of the first device 61.

The process now repeats at the third ring element 43; the sugar crystals that have already been impacted and circulated at two abrupt transitions between the ring elements are again transported downwardly on the conical inner wall.

At the lower rim thereof, there now follows a third such abrupt transition, namely here, onto the lower reaction of the inner wall of the bell 50 which simultaneously forms the fourth ring element 54. Since the bell 50 together with the product distributor 40 are rotating about the same axis 16 and the frequency of rotation is identical, the abrupt transition process is similar to that occurring between the individual, ring elements 41, 42 and 43. Here however, there is now no device 61, 62 incorporating air guidance elements, although such a device would be also conceivable in special embodiments. As indicated here instead, there are spacers 67 which create a connection between the lowest ring element 13 of the product distributor 40 and the inside of the be 50 above the ring element 54.

These spacers 67 could also he constructed in the form of air guidance elements. They can also be provided at other positions. The provision of connecting elements at other locations is also possible. Both the spacers 67 and any other connecting elements could be provided in the form of detachable components.

As mentioned hereinabove, projections 48 are rigidly connected to the upper cover 47 for the purpose of ensuring that the bell 50 rotates in synchronism with the product distributor 40 and its ring elements 41, 42, 43.

The ring elements 41, 42, 43 are also connected firmly together by the devices 61 and 62 so that further retaining devices or struts are no longer required.

Flow-optimised sheets preferably implemented as plug-in units can likewise be perceived on the projections 48 between the product distributor 40 and the bell 50. These sheets that serve to optimise the flow of the media likewise give rise to a suction effect acting from top to bottom, or differently expressed, they push the air, the steam or the other medium downwardly within the interior of the bell 50 to a certain extent. Here, there is a further device 64 incorporating air guidance elements, but this however does not produce a suctional flow though sugar massecuites that are being centrifuged outwardly, but rather, merely creates a flow of air within the interior of the bell 50.

Here and in contrast to the conventional centrifuge known from EP 0 487 780 B1, there is no difference in speed between the bell and the product distributor. This thus enables spatial Proximity between static parts on the one hand and rapidly rotating parts on the other to be avoided. In consequence, it also avoids the need to provide appropriate safeguards that must be met for the prevention of malfunctions in extreme cases.

Instead, a co-rotating hood or bell is inverted over the multi-stage product distributor, whereby this co-rotating bell simultaneously forms the last stage or she last ring element for the product distributor. This arrangement has the advantage that the medium, i.e. preferably the steam, water or syrup that is introduced for the treatment of the crystal suspension, is completely mixed into the crystal suspension of the sugar massecuites and then this mixture is accelerated continuously until its exit from the last stage of the lower ring element.

The medium is supplied above the rotating parts through the tubular supply element 52 (c.f. FIG. 1) to one or more locations and is drawn through the baffle plates of the device 64 into the region between the bell 50 and the product distributor 40. Optimal distribution of the medium in the space between the inner surface of the bell 50 and the outer surface of the product distributor 40 is achieved due to the rapid rotation of all the parts. At each stage, a portion of the aforementioned medium is brought into contact with the sugar massecuite by means of the devices 61, 62 incorporating the air guidance elements or baffle plates, wings or blades. The last mentioned stage results from the lump of the crystal suspension from the product distributor 40 to the co-rotating bell 50. Here, the residual portion of the medium is mixed with the crystal suspension.

Due to the rotation in common of the bell 50 and the product distributor 40, there is no longer any need to consider the provision of a safety margin between these two components. The space between these two parts can thus be conceived in such a way that, for each stage and for each jump of the sugar massecuites, the optimal quantity of medium is fed from the interior of the bell 50 into the product distributor 40 or sucked through the devices 61, 62 incorporating the air guidance elements, baffle plates, blades or wings.

In each case, there is a jump-gap between the ring elements 41, 42, 43, 54 which has to be negotiated by the sugar crystals. This jump-gap between the individual stages can be co-ordinated with an appropriate choice of the diameters of the ring elements in dependence on the quantity of the sucked-in medium that has to be introduced into the respective stage in each case. If, thereby, one assumes a value of a for representing the total magnitude of all the jumps and a value of n for the number of stages that are provided, then this results in values of between a/n and a/2 for the choice of the distances between two ring elements or for the size of a lump. If, for various reasons, one would like to supply a relatively large amount of steam into the first stage for example, then one can increase the distance between the upper rim 33 of the product distributor 40 and the inner surface of the highest ring element 41 accordingly, but, in order to compensate, make the distances between the other ring elements correspondingly smaller. One can proceed in like manner between the other ring elements. To this end, the ring elements and the air directing elements are exchanged in each case.

In the illustrated embodiment, this number of stages is given by the three ring elements 41, 42, 43 and the fourth ring element. 54; however, a smaller or larger number of ring elements could also be envisaged. The illustrated form is however the preferred design.

The distance between the product distributor 40 and the sieve basket 20 i.e. then centrifuge drum can also be implemented optimally by the rotation of all the parts at the same frequency. This means that the distributor pot 30 serving as the feed point for the crystal suspension can also be implemented with a greater diameter in order to achieve better treatment for the sugar massecuites.

A sectional view is shown again in FIG. 3, namely in the form of the detail of the centrifuge that can be seen in the perspective illustration depicted in FIG. 2. One thus sees the exterior of the bell 50 which forms the fourth ring element 54 in the lower region thereof, and within it, the product distributor 40 comprising the other three ring elements 41, 42, 43. Between the ring elements 41 and 42 on the one hand and 42 and 43 on the other, one can see the respective devices 61 and 62 incorporating the air guidance elements which are merely suggested here. One perceives however that the medium between the inner surface of the bell 50 and the outer surface of the ring elements 41, 42 and 43 of the product distributor 40 is being drawn in through these devices 61 and 62 into the interior of the product distributor 40.

In the interior of the product distributor 40 towards the top, one can see within the first ring element 41, the distributor pot 30 with its cylindrical wall 32 and the upper rim 33 thereof as well as the bars 34 on the base 31. The upper rim 33 of the cylindrical wall 32 of the distributor pot. 30 is not covered here and clearly shows that the sugar massecuites are spun-off to the exterior from this upper rim 33 once the pot is appropriately filled therewith and they then strike the inner wall, of the conically downwardly flaring first ring element 41.

The further process occurs as was described in FIGS. 1 and 2,

LIST OF REFERENCE SYMBOLS

10 fixed framework
11 base of the framework
12 side wails of the framework
13 cover of the framework
14 filler funnel
15 shaft
16 vertical axis
20 sieve basket
21 deflector plate
22 upper rim of the sieve basket
30 distributor pot
31 base of the distributor pot
32 cylindrical walls of the distributor pot
33 upper rim of the distributor' pot.
34 bars
40 product distributor
41 ring element
42 ring element
43 ring element
47 upper cover of the product distributor
48 projections for the connection of the product distributor to the bell
50 bell
52 supply element for the bell
54 ring element
61 device incorporating air guidance elements
62 device incorporating air guidance elements
64 device incorporating air guidance elements
67 spacer

What is claimed is:

1. A continuously operating centrifuge for centrifuging sugar massecuites, comprising a) a conically upwardly flaring sieve basket which rotates about a vertical axis, b) a downwardly flaring product distributor which extends down to the bottom region of the sieve basket, is substantially coaxial with the sieve basket, forms a discharge rim at the bottom thereof and rotates about the same vertical axis as the sieve basket, c) a distributor pot which is disposed within and in the upper region of the product distributor and serves as a feeding device for the sugar massecuites in the axial region of the centrifuge, d) the product distributor including a peripheral wall having a plurality of separate annular ring elements which overlap in the direction of the axis, having an annular gap defined between adjacent ones thereof and the inside diameters thereof differ from each other, e) a conically downwardly flaring bell which surrounds the product distributor, characterized, in that a device having air directing elements is disposed within the annular gap defined between at least two adjacent annular ring elements of the product distributor, and in that the device having air directing elements comprises a base planar annular metal sheet, and a multiplicity of sheet metal surface areas that issue upwardly from the base planar annular metal sheet to form upwardly extending wings or blades.

2. A continuously operating centrifuge in accordance with claim 1, characterized, in that the device having the air directing elements forms a firm connection between adjacent annular ring elements.

3. A continuously operating centrifuge in accordance with claim 1, characterized, in that three ring elements are provided.

4. A continuously operating centrifuge in accordance with claim 1, characterized, in that the devices incorporating the air directing elements are pressed parts into which lines are inscribed by means of a laser.

5. A continuously operating centrifuge in accordance with claim 1, characterized, in that the upwardly extending wings or blades are set at an angle of more than 30° and less than 50°.

6. A continuously operating centrifuge in accordance with claim 5, characterized in that the angle is adjustable.

7. A continuously operating centrifuge in accordance with claim 1, characterized, in that the conically downwardly flaring bell surrounding the product distributor rotates about the axis at the same frequency as the product distributor.

8. A continuously operating centrifuge in accordance with claim 7, characterized, in that a lowest region of an inner wall of the conically downwardly flaring bell protrudes downwardly beyond the product distributor and forms a further ring element for the capture and the further transportation of the sugar massecuites spun off from the discharge rim of the product distributor.

9. A continuously operating centrifuge in accordance with claim 8, characterized, in that spacers are also provided between a largest diameter ring element of the product distributor and the lowest region of the inner wall of the bell.

10. A continuously operating centrifuge in accordance with claim 1, characterized, in that the product distributor comprising the ring elements and the devices incorporating the air directing elements is exchangeable for other product distributors having a differing number of ring elements and/or ring elements having other types of and/or differently spaced ring elements.

11. A continuously operating centrifuge in accordance with claim 1, characterized, in that there is provided a supply element through which air, steam, or steam enriched with syrup droplets is supplied to the interior of the conically downwardly flaring bell.

12. A continuously operating centrifuge in accordance with claim 11, characterized, in that the supply element for the bell leads into the conically downwardly flaring bell from above.

13. A continuously operating centrifuge in accordance with claim 1, characterized, in that the bell has a lower ring element;

in that three ring elements are provided at the product distributor.

14. A continuously operating centrifuge in accordance with claim 13, characterized, in that the devices incorporating the air directing elements are pressed parts into which lines are inscribed by means of a laser, and in that the lines are arranged in such a manner as to enable regions to be bent up.

15. A continuously operating centrifuge in accordance with claim 1, characterized, in that three ring elements are provided, in that the devices incorporating the air directing elements are pressed parts into which lines are inscribed by means of a laser, in that the lines are arranged in such a manner as to enable regions to be bent up, and in that the upwardly extending wings or blades are set at an angle of more than 30° and less than 50°.

16. A continuously operating centrifuge in accordance with claim 15, characterized, in that the angle is adjustable.

17. A continuously operating centrifuge in accordance with claim 1, characterized, in that three ring elements are provided, in that the devices incorporating the air directing elements are pressed parts into which lines are inscribed by means of a laser, and in that the upwardly extending wings or blades are set at an angle of more than 30° and less than 50°, and in that the conically downwardly flaring bell surrounding the product distributor rotates about the axis at the same frequency as the product distributor.

18. A continuously operating centrifuge in accordance with claim 17, characterized, in that the lowest region of the inner wall of the bell protrudes downwardly beyond the product distributor and forms a further ring element for the capture and the further transportation of the sugar massecuites spun off from the discharge rim of the product distributor, in that spacers are also provided between a largest diameter ring element of the product distributor and the lowest region of the inner wall of the bell.

19. A continuously operating centrifuge in accordance with claim 18, characterized, in that the product distributor comprising the ring elements and the air directing elements is exchangeable for other product distributors having a differing number of ring elements and/or ring elements having other types of and/or differently spaced ring elements, in that there is provided a supply element through which air, steam, or steam enriched with syrup droplets is supplied to the interior of the bell, and in that the supply element for the bell leads into the bell from above.

20. A continuously operating centrifuge for centrifuging sugar massecuites, comprising a) a conically upwardly flaring sieve basket which rotates about a vertical axis, b) a downwardly flaring product distributor which extends down to the bottom region of the sieve basket, is substantially coaxial with the sieve basket, forms a discharge rim at the bottom thereof and rotates about the same vertical axis as the sieve basket, c) a distributor pot which is disposed within and in the upper region of the product distributor and serves as a feeding device for the sugar massecuites in the axial region of the centrifuge, d) the product distributor including a peripheral wall having a plurality of separate annular ring elements which overlap in the direction of the axis, and the inside diameters thereof differ from each other, e) a conically downwardly flaring bell which surrounds the product distributor, characterized, in that a device having air directing elements is provided between a largest diameter ring element of the product distributor and an inner surface of the conically downwardly flaring bell, and in that the device having air directing elements comprises a base planar annular metal sheet, and a multiplicity of sheet metal surface areas that issue upwardly from the base planar annular metal sheet to form upwardly extending wings or blades.

21. A continuously operating centrifuge in accordance with claim 20, characterized, in that an annular gap is formed between adjacent annular ring elements and a further device having air directing elements is disposed within the annular gap.

22. A continuously operating centrifuge in accordance with claim 20, characterized, in that the largest diameter ring element is the lowest position ring element.

* * * * *